United States Patent [19]

Buxmann et al.

[11] Patent Number: 4,625,788

[45] Date of Patent: Dec. 2, 1986

[54] APPARATUS AND METHOD FOR THE CONTINUOUS CASTING OF METAL

[75] Inventors: Kurt Buxmann, Sierre; Martin Bolliger, Venthône, both of Switzerland

[73] Assignee: Swiss Aluminium Ltd., Chippis, Switzerland

[21] Appl. No.: 639,334

[22] Filed: Aug. 10, 1984

[30] Foreign Application Priority Data

Aug. 24, 1983 [CH] Switzerland ..... 4606/83

[51] Int. Cl.[4] ..... B22D 11/06

[52] U.S. Cl. ..... 164/481; 164/491; 164/436; 164/431; 164/432

[58] Field of Search ..... 164/439, 440, 488–490, 164/491, 436, 418, 459, 437, 438, 479, 429, 427, 432, 431, 481

[56] References Cited

U.S. PATENT DOCUMENTS

| | | | |
|---|---|---|---|
| 3,451,465 | 6/1969 | Moritz | 164/440 X |
| 4,010,793 | 3/1977 | Takemura et al. | 164/436 X |
| 4,122,890 | 10/1978 | Atkins et al. | 164/439 X |
| 4,505,319 | 3/1985 | Kimura | 164/432 |

FOREIGN PATENT DOCUMENTS

| | | | |
|---|---|---|---|
| 239979 | 3/1965 | Austria | 164/440 |
| 761483 | 7/1971 | Belgium | 164/440 |
| 3201633 | 7/1983 | Fed. Rep. of Germany | 164/440 |
| 56-105850 | 8/1981 | Japan | 164/436 |

*Primary Examiner*—Kuang Y. Lin

*Attorney, Agent, or Firm*—Bachman & LaPointe

[57] ABSTRACT

In an apparatus for the continuous casting of metal, especially with a casting machine having circulating molds, the metal flows as a melt out of a nozzle, if appropriate with a nozzle mouthpiece, between molds and solidifies between side-limiting elements. The mouthpiece has adjoining it on each of its two sides a baffle which is followed in the casting direction by a cooling block. Between the baffle and cooling block there is a gap through which a gas can be blown into a corner region formed by the baffle, cooling block and melt, this gas forming a gas cushion in this corner region. The throughflow width of the molten metal between the baffles located opposite one another can be changed as a result of the movement of the baffles in the direction. The same applies to the width of the cooling blocks located opposite one another.

5 Claims, 2 Drawing Figures

APPARATUS AND METHOD FOR THE CONTINUOUS CASTING OF METAL

BACKGROUND OF THE INVENTION

The invention relates to an apparatus and method for the continuous casting of metal, especially with a casting machine having circulating or roller molds, the metal flowing as a melt out of a nozzle, if appropriate with a nozzle mouthpiece, between the molds and solidifying between side-limiting elements.

For the continuous casting, particularly, of ferrous and non-ferrous metals, machines having a mold with continuously advancing walls have been developed. These machines include those in which casting is carried out between two rotating steel bands. Machines are also known in which the casting mold is formed by a double row of mold halves which are combined into two endless rotating chains. At the casting end, the mold halves located opposite one another come up against one another and in this position move a certain distance over which they form the actual chain mold. After that, they separate from one another and meet up agains after a short time at the pouring nozzle.

Particularly in machines with chain molds for the casting of relatively thin metal strips, for example strips with a thickness of only 20 mm and below, the region round the feed nozzle and the feed nozzle itself are the parts of the entire casting installation which present most problems. This is primarily because both the mechanical stress on the parts of the installation and the stress on them as a result of the very high metal temperature are the greatest.

The molten metal or the metal strip solidifying between the molds is conventionally engaged laterally by revolving side-limiters. These side-limiters require a high outlay in terms of the cost of installation and maintenance, especially because different side-limiters are also required for different cast-strip thicknesses. In particular, their susceptibility to faults is very high because the distance between the side-limiter and nozzle and also between the side-limiter and mold must be adjusted with the highest possible accuracy and maintained during the casting operation. Furthermore, the known side-limiters do not allow the width of a cast metal strip to be changed during the casting operation. However, this is a considerable disadvantage, since it is possible to match the cast-strip width to an ordered width only to a limited extent, usually by staggering in steps. Exact cutting to width then has to be carried out by a trimming the strip, and this again results in considerable metal waste, involving further labour costs.

The inventor has made it his aim to develop an apparatus and a process of the type mentioned above, in which the width of the cast strip can be adjusted, preferably actually during the casting operation, and at the same time the flow of molten metal is controlled more efficiently. In addition, controlled lateral cooling is also to be effected.

SUMMARY OF THE INVENTION

To achieve this object, apparatus for the continuous casting of metal comprises, molds; a nozzle from which, in use molten metal flows to between the molds and between the side-limiting elements where the molten metal solidifies, characterized in that the side limiting elements include, downstream of each side of the nozzle, a baffle, which adjoins the nozzle, and, in use, interrupts the side of the flow of molten metal, and a cooling block downstream of the baffle; and in that the width of the flow path between the side-limiting elements is variable.

The particular advantage of the baffle is that the melt does not additionally flow laterally behind the nozzle mouthpiece which is in any case already exposed to very high erosion forces. As a result, the service life of the very expensive nozzle is lengthened. The cooling block, which is positioned downstream of the baffle, causes controlled lateral cooling of the molten metal or of the solidifying metal strip and this has a very positive effect on the quality of the metal strip, especially in the edge region.

The baffle preferably consists of a refractory material, such as Marinite or Monalite. In contrast, the cooling block should consist of a metal which has a higher melting point than the metal to be cast. For example, in the casting of aluminum, the cooling block may consist of copper. On the other hand, in the casting of steel, it would be possible to use a cooling block also consisting of steel.

The baffle and cooling block may be aligned relatively to one another so that beteen them they form a gap through which a gas can be blown into contact with the molten metal in a corner region between the baffle and cooling block. As a rule, the cooling block should be arranged somewhat offset outwardly in relation to the baffle. The molten metal then flows round the baffle and strikes the cooling block, at the same time forming a corner region. If the melt were to flow into this corner and possibly solidify partially there, this would have an adverse effect on the quality of the strip edge. However, because gas is blown in, a gas cushion forms in the corner region and forces the melt out of this corner region. To assist this effect there can also be, in the cooling block, a channel, if appropriate with a reservoir, through which a lubricant, for example oil, can be forced into the corner region between the cooling block and baffle. This lubricant also assists the efforst of the metal, slowly solidifying at the edge of the cast strip, to slide along the cooling block, until the crust reaches a load-bearing thickness and the metal strip shrinks away from the cooling block.

The cooling block may itself have an annular channel for conveying a coolant, usually water.

A further essential feature of the present invention is that the throughflow width of the molten metal between the side-limiters located opposite one another can be adjusted. For this purpose, the baffles themselves may be replaceable, or movable towards or away from one another either manually or automatically. As a result of this measure, for example the flow speed of the molten metal can be varied and matched to desired conditions, preferably even during cassting. For example, a higher flow speed also ensures that the molten metal makes less effort to flow behind the baffles. Furthermore, at a higher speed, the metal solidifies only at a later time, so that, if appropriate, its structure can be influenced.

Preferably, the cooling block located opposite one another are also designed so as to be replaceable or movable relativey to one another. This results in the very important possibility that the width of the metal strip can be changed, preferably during casting without the casting operation itself having to be interrupted. At the same time, there is no need for subsequent trimming of the strip, thus ensuring less metal waste and a reduction in production costs. It is also within the scope of the invention that, if appropriate, the baffles should be stationary, whilst only the cooling blocks should be designed so that their positions can be changed. Moreover, the cooling blocks are preferably displaced very slowly, for example 1 cm per minute.

A spray nozzle may be located downstream of the cooling block for spraying air, or air and water, onto the strand of metal and by means of which a water mist is sprayed onto the metal strip to prevent the latter from being melted down again.

The invention also includes a method of continuously casting metal, utilizing a casting machine having molds, wherein the metal is caused to flow as a melt out of a nozzle between the molds and to solidify between side-limiting elements, characterized in that the width of the metal strip solidifying between the side-limiting elements is changed during casting.

BRIEF DESCRIPTION OF THE DRAWING

Further advantages, features and details of the present invention will be made clear from the detailed description with the aid of the following drawings wherein.

DETAILED DESCRIPTION

Figure 1:
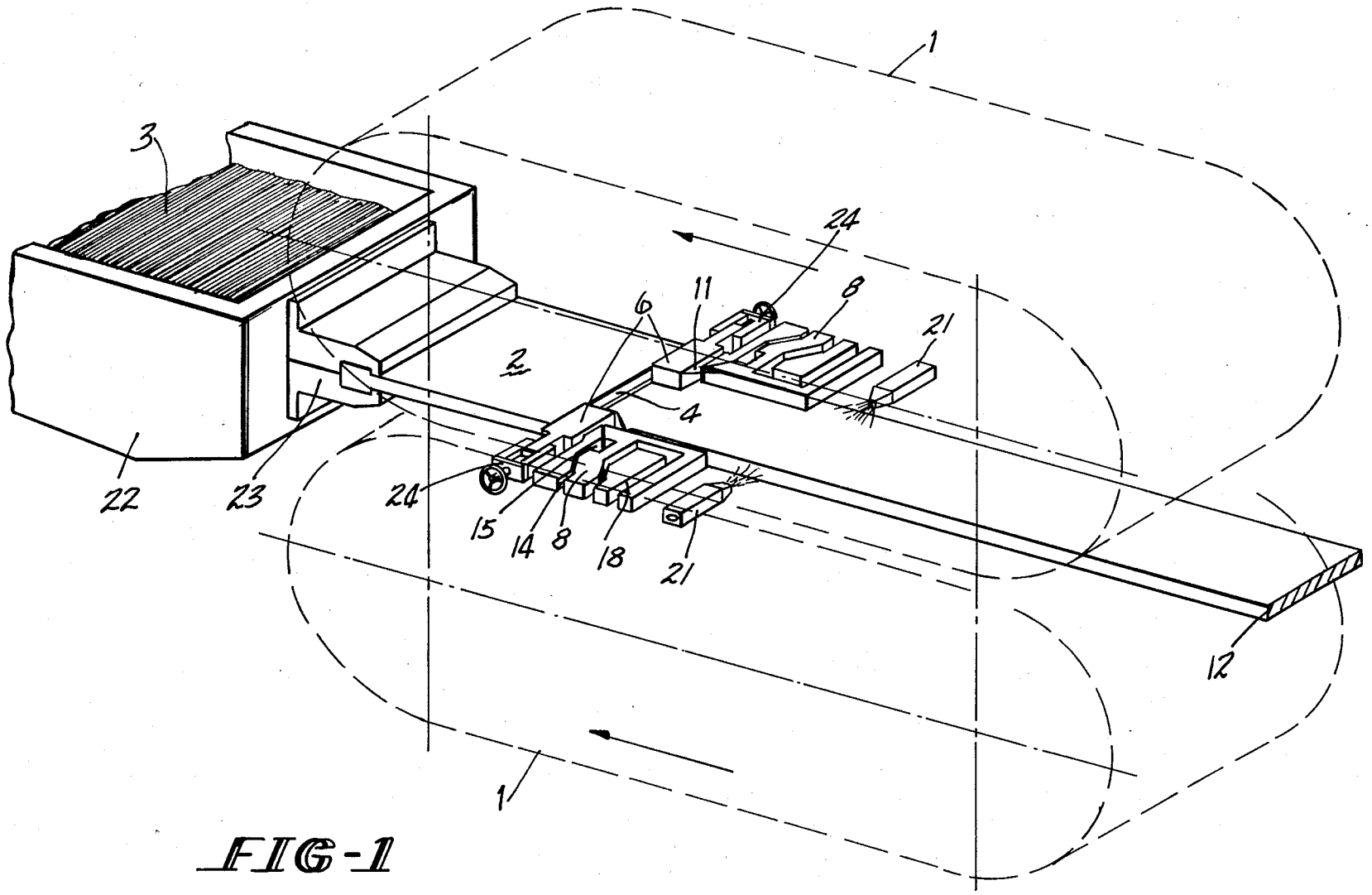
FIG. 1 is a schematic illustration showing the apparatus of the present invention is combination with a continuous casting machine.
Figure 2:
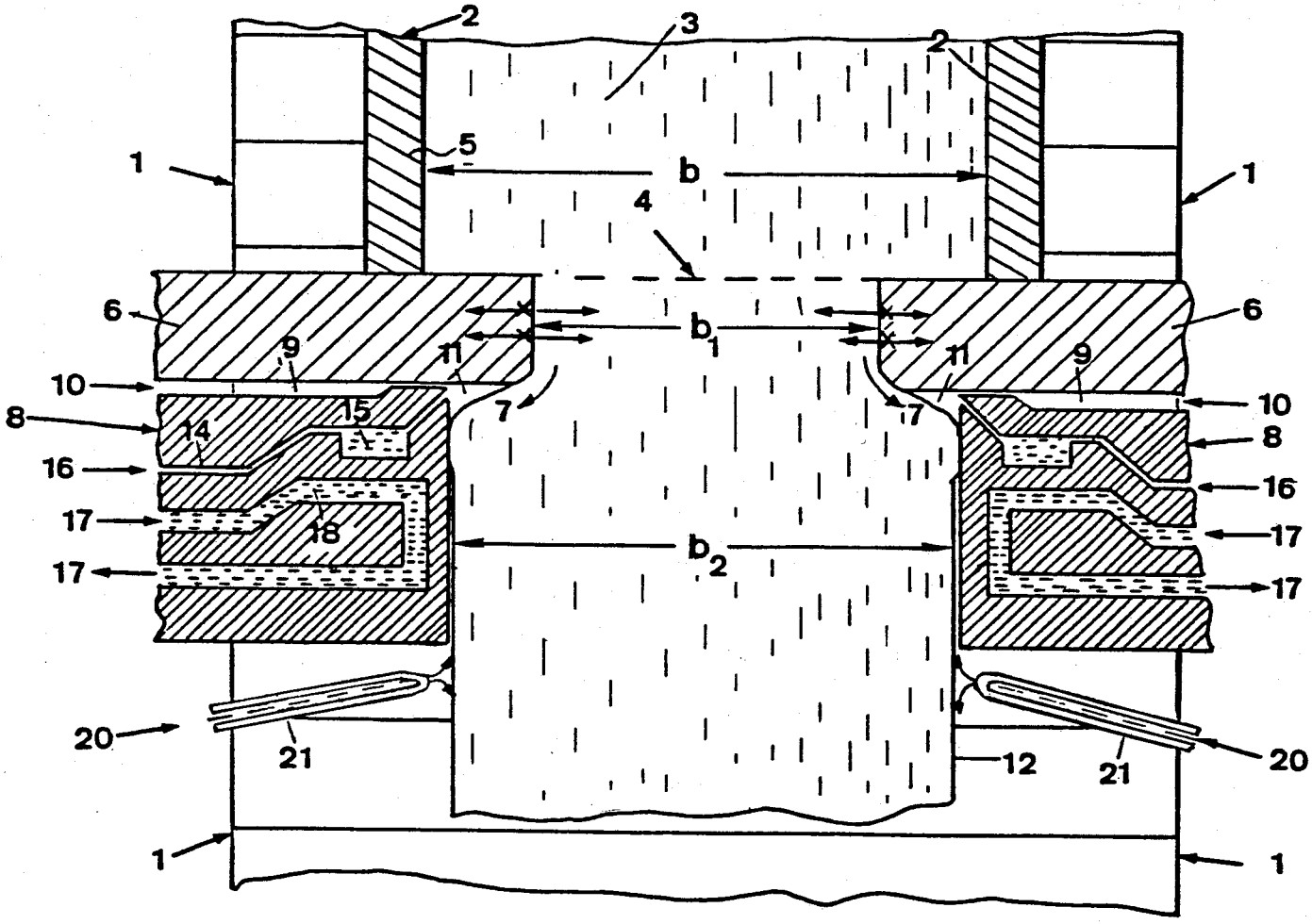
FIG. 2 is a partial section showing the detailed features of the apparatus of the present invention.

The illustrated apparatus comprises a casting machine with a circulating mold 1 in the region of an outlet 4 of a nozzle mouthpiece 2, through which molten metal 3 flows out from tundish 22 to between molds, of which only a lower mold 1 is shown for the sake of clarity. The molten metal, guided by walls 5 of the nozzle mouthpiece 2 in a width b, moves towards the outflow 4. There, the width b of the stream of molten metal 3 is reduced to a width $b_1$ by baffles 6. The melt 3 thereafter flows round the baffles 6, as indicated by arrows 7, and strikes a cooling block 8. This ensures as a result of cooling that the melt 3 solidifies and contracts to the final width $b_2$ of the cast metal strip (shown solidified).

The baffles 6 preferably consist of an insulating material, for example Marinite or Monalite, whilst the cooling block 8 can be made of a metal with a melting point which is suitable for the melt 3.

Between the baffles 6 and the cooling blocks 8 there is a gap 9 which receives a gas as indicated by the arrow 10. This gas, preferably air, prevents the melt 3 from penetrating into the corner region 11 between the baffle 6 and the cooling block 8, this being very important for the quality of the edge 12 of the strip. To improve the formation of an air cushion and improve the sliding capacity of the metal strip, in addition to the gas 10, a lubricant 16, for example, oil is introduced into the corner region 11 through a channel 14 with a reservoir 15 in the cooling block 8.

Cooling itself is carried out when a coolant 17, preferably water, is introduced into an annular channel 18 in the cooling block 8.

The metal flowing out of the cooling block is subsequently subjected to compressed air 20 from nozzles 21, to prevent the metal from being melted down again. Water is preferably also added to the compressed air 20, so that a cooling water mist is obtained.

The baffles 6 are adjustable by adjusting means 24 in the direction X, so that the width $b_1$ can be changed. The cooling block 8 will also be variable by adjusting means similar to adjusting means 24 (not shown) in the direction X either separately or together with the baffles 6, so that the final width $b_2$ of the metal strip can be determined by these side-limiting elements.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

I claim:

1. An apparatus for the continuous casting of moletn metal wherein molten metal is fed to a mold defined by a pair of continuously advancing surfaces comprising a nozzle having a front face defining an opening of a width b for feeding molten metal to said mold, side-limiting means immediately downstream of said nozzle and in contact with said front face for prohibiting the flow of molten metal by said front face, said side-limiting means comprises at least a pair of baffles defining a width $b_1$ and at least a pair of cooling blocks immediately downstream of said pair of baffles defining a width $b_2$ and means associated with said side-limiting means for varying the width of at least one of said width $b_1$ and said width $b_2$.

2. An apparatus according to claim 1 wherein said cooling blocks are spaced from said baffles so as to define a passage and gas means communicates with said passage for communicating gas through said passage such that said gas contacts said molten metal in the corner regions formed by said baffles and said cooling blocks so as to prohibit metal from flowing between said baffles and said cooling blocks.

3. An apparatus according to claim 2 wherein a channel is provided in one of said baffles and said cooling blocks and lubricant means communicates with said channel for communicating lubricant through said channel such that said lubricant contacts said molten metal in the corner regions formed by said baffles and said cooling blocks so as to prohibit metal from flowing between said baffles and said cooling blocks.

4. An apparatus according to claim 1 wherein nozzles are provided downstream of said cooling blocks for spraying a cooling medium on the metal strand.

5. In a method of controlling the width of a casting strip cast with an apparatus which includes a mold defined by a pair of continuously advancing surface, the method comprises the steps of providing a nozzle having a front face defining an opening of a width b for feeding molten metal to said mold, providing at least a pair of baffles defining a width $b_1$ immediately downstream of said nozzle and in contact with said front face for prohibiting the flow of molten metal by said front face, positioning at least a pair of cooling blocks defining a width $b_2$ downstream of said baffles, feeding molten metal to said nozzle, said baffles and said cooling blocks and varying the width of said width $b_2$.

* * * * *